US011591881B2

(12) United States Patent
Mhaskar et al.

(10) Patent No.: US 11,591,881 B2
(45) Date of Patent: Feb. 28, 2023

(54) CONE FOR A DOWNHOLE TOOL

(71) Applicant: Weatherford Technology Holdings, LLC, Houston, TX (US)

(72) Inventors: Nauman H. Mhaskar, Cypress, TX (US); Jorge Reyes Villegas, Houston, TX (US); Jose L. Arredondo, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/203,968

(22) Filed: Mar. 17, 2021

(65) Prior Publication Data

US 2022/0298883 A1 Sep. 22, 2022

(51) Int. Cl.
*E21B 23/06* (2006.01)
*E21B 33/129* (2006.01)

(52) U.S. Cl.
CPC ..... *E21B 33/129* (2013.01); *E21B 23/06* (2013.01)

(58) Field of Classification Search
CPC ..... E21B 23/06; E21B 33/129
See application file for complete search history.

(56) References Cited

U.S. PATENT DOCUMENTS 7,048,055 B2 5/2006 Hirth
9,273,527 B2 3/2016 Badrak
9,284,803 B2 * 3/2016 Stone ..... E21B 23/01
9,470,060 B2 10/2016 Young et al.
9,574,415 B2 * 2/2017 Xu ..... E21B 23/06
9,611,708 B2 4/2017 Rios, III
9,643,250 B2 5/2017 Mazyar et al.
9,759,035 B2 9/2017 Fripp et al.
9,896,901 B2 * 2/2018 Sommers ..... E21B 33/128
9,950,370 B2 4/2018 Roth-Fagaraseanu et al.
9,969,003 B2 5/2018 Binder et al.
10,011,044 B2 7/2018 Campomanes et al.
10,081,853 B2 9/2018 Wilks et al.
10,092,953 B2 10/2018 Mazyar et al.
10,167,534 B2 1/2019 Fripp et al.
10,265,770 B2 4/2019 Wilkinson
10,428,616 B2 * 10/2019 Dirocco ..... E21B 33/128
11,028,666 B2 * 6/2021 Sommers ..... E21B 33/129
11,078,744 B2 * 8/2021 Kennedy ..... E21B 33/128
11,293,244 B2 4/2022 Mhasksar et al.
2005/0173126 A1 8/2005 Starr et al.
2007/0181224 A1 8/2007 Marya et al.
2016/0024619 A1 1/2016 Wilks et al.
2017/0218713 A1 8/2017 Walton et al.
2017/0234103 A1 8/2017 Frazier
2018/0238133 A1 8/2018 Fripp et al.
2019/0352998 A1 * 11/2019 Wolf ..... E21B 33/128
2020/0040680 A1 2/2020 Mhaskar et al.

* cited by examiner

*Primary Examiner* — Matthew R Buck
(74) *Attorney, Agent, or Firm* — Booth Albanesi Schroeder PLLC; Peter V. Schroeder

(57) ABSTRACT

A downhole tool for use in a wellbore includes a cone, a cone adapter at least partially disposed in the cone, a shoe member, and a slip assembly disposed between the cone and the shoe member. A mandrel extends through the cone adapter and attached to the shoe member. The cone adapter is retrievable with the mandrel.

19 Claims, 6 Drawing Sheets

CONE FOR A DOWNHOLE TOOL

BACKGROUND

Field

Embodiments of the present disclosure generally relate to a downhole tool having a cone with a thinner profile.

Description of the Related Art

A downhole tool, such as a bridge plug or a packer, can include a slip and a cone disposed on a mandrel. In operation, the slip and the cone are moved toward one another to cause the slip to move away from the mandrel and engage against a surrounding tubular or casing. Either the slip is pushed against the ramped surface of the cone, the cone is pushed under the slip, or both.

After the slip is set, a ball is released into the casing and lands in the cone. Pressure may be increased to open a sliding sleeve or valve and force the fluid out of the casing. Thereafter, the plug, including the cone, is removed, such as by milling.

The construction of a cone for a larger diameter plug requires more time and costs. The larger cone also has more material that needs to be removed, such as by milling.

There is, therefore, a need for a cone that is more efficient and cost effective to manufacture. There is also a need for a cone that takes less time to mill.

SUMMARY

In one embodiment, a downhole tool for use in a wellbore includes a cone, a cone adapter at least partially disposed in the cone, a shoe member, and a slip assembly disposed between the cone and the shoe member. A mandrel extends through the cone adapter and attached to the shoe member. The cone adapter is retrievable with the mandrel.

In one embodiment, a method of performing a wellbore operation includes deploying a downhole tool into a wellbore using a setting tool. The downhole tool includes a cone supported by a cone adapter, a slip assembly; and a mandrel extending through the cone adapter and releasably attached to a shoe member. The method also includes using the setting tool to engage the slip assembly with a downhole surface, detaching the mandrel from the shoe member; and moving the cone adapter from the cone by retrieving the mandrel.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIG. 2 illustrates a cross-sectional view of the downhole tool shown in FIG. 1 during run-in.

FIG. 3 illustrates a cross-sectional view of the downhole tool shown in FIG. 1 after the slip assembly has been set.

FIG. 4 illustrates a cross-sectional view of the downhole tool shown in FIG. 1 after the mandrel separates from the shoe member.

FIG. 5 illustrates a cross-sectional view of the downhole tool shown in FIG. 1 after the cone adapter moves away from the cone.

FIG. 6 illustrates a cross-sectional view of the downhole tool shown in FIG. 1 after an object has landed in the cone.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
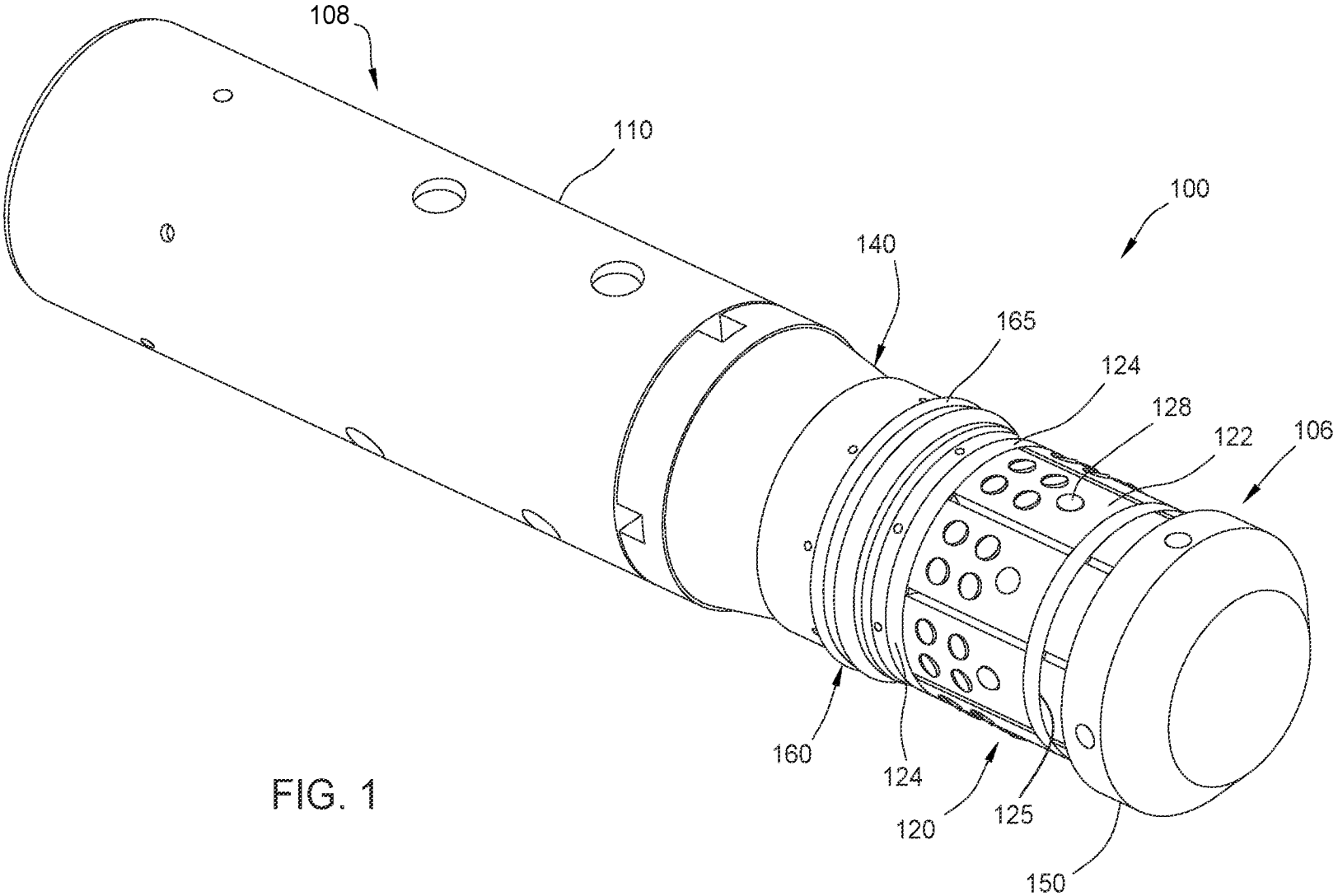
FIG. 1 illustrates a perspective view of a downhole tool, according to one embodiment.

FIG. 1 is a perspective view of a downhole tool 100 according to one embodiment of this disclosure. The downhole tool 100 may be a bridge plug as shown, but it could also be a downhole tool with a seat configured to catch an object and a slip assembly configured to grip a downhole surface.

Figure 2:
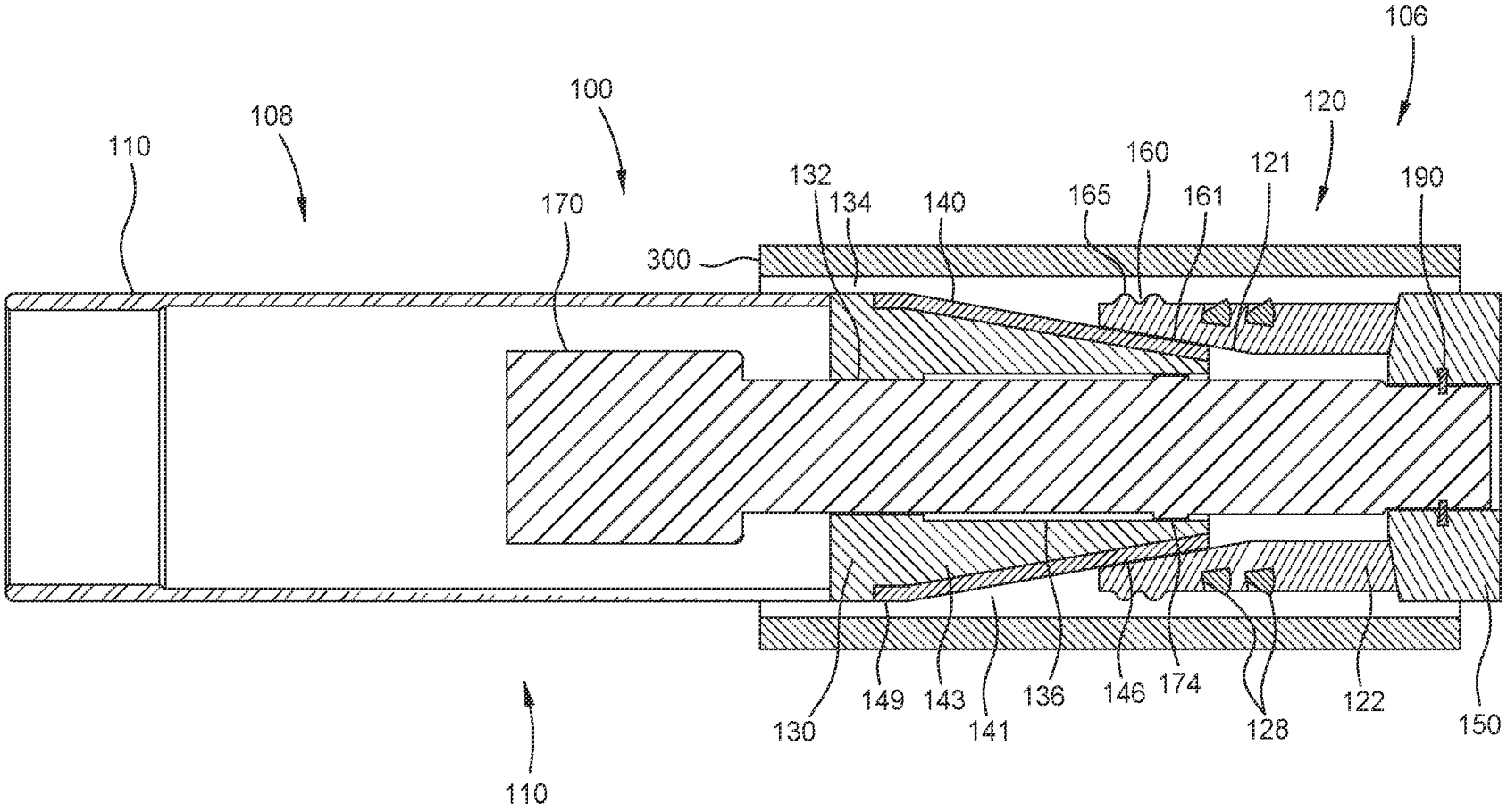
FIGS. 2-6 illustrate an exemplary sequential operation of the downhole tool of FIG. 1.

FIG. 2 is a cross-sectional view of FIG. 1. As shown, the downhole tool 100 may include a setting sleeve 110, a slip assembly 120, a cone adapter 130, a cone 140, a shoe member 150, a seal assembly 160, a mandrel 170, and an attachment member 190.

The downhole tool 100 has a first portion 106 and a second portion 108. The first portion 106 includes the slip assembly 120, the cone 140, the shoe member 150, and the seal assembly 160. The second portion 108 includes the setting sleeve 110, the mandrel 170, and the cone adapter 130. The second portion 108 may be used to set one or more components of the first portion 106 downhole. The second portion 108 may be separated from the first portion 106 downhole. While the first portion 106 remains downhole, the second portion 108 may be retrieved to surface.

The cone 140 includes an inclined outer surface 141 and a bore 143. In one embodiment, the cone 140 is made from a sheet of metal. For example, the sheet of metal is cut and rolled to form the cone 140. In this respect, the inner surface of the cone 140 defines the bore 143. The incline bore 143 of the cone 140 can serve as a seat to catch an object, such as a ball. The inclined outer surface 141 may include a friction surface 146. The friction surface 146 may include a plurality of teeth. In some embodiments, the outer surface of the cone 140 has two or more incline angles. In the example of FIG. 2, the upper portion 149 of the cone 140 has a different incline angle than the lower portion of the cone 140, which lower portion has a smaller outer diameter than the upper portion 149. The outer diameter of the upper portion 149 of the cone 140 may be the same as the outer diameter of the setting sleeve 110. In one embodiment, the thickness of the cone 140 is the same as the thickness of the setting sleeve. In some embodiments, at least a portion of the cone has a thickness from 0.2 in. to 2 in., from 0.25 in. to 1.5 in., or from 0.3 in. to 0.8 in. For example, a majority portion of the cone has a thickness from 0.3 in. to 1 in. In some embodiments, the upper portion is thicker than the lower portion of the cone 140, or vice versa. In some embodiments, the cone is made from a composite material such as polyglycolic acid (PGA), polylactic acid (PLA), polyurethane, and a mixture thereof. The PGA and PLA materials may also be reinforced. If the reinforcement is non-degradable, it can be flowed out of the well after the matrix has been degraded. In some embodiments, the cone is made from a dissolvable material or powder metal. In some embodiments, the cone is manufactured using stamping, hot forging, casting, or injection molding.

The cone 140 is disposed around the outer surface of the cone adapter 130 during run-in. The cone adapter 130 includes a bore 132 extending therethrough. In one embodiment, the outer surface of the cone adapter 130 has an incline that is complementary to the incline of the inner surface of the cone 140. In one example, the outer surface of the cone adapter 130 extends along the entire length of the cone 140. In one embodiment, the thickness of the cone 140 at the upper end of the incline is thinner than the thickness of the cone adapter 130 at the same axial location. The thickness of the cone 140 at the lower end of the incline can be thinner, thicker, or the same as the thickness of the cone adapter 130 at the same axial location. In one embodiment, the upper portion of the cone adapter 130 has a shoulder 134 that extends out radially above the top end of the cone 140 and situated between the top end of the cone 140 and the lower end of the setting sleeve 110. The setting sleeve 110 may abut the top end of the cone adapter 130. The cone adapter 130 can be made from a high strength metallic or non-metallic material.

The cone adapter 130 may optionally include protrusions configured to maintain the alignment of the setting sleeve 110 with the cone adapter 130. The protrusions may be one or more ribs. The protrusions may have a close tolerance with the inner diameter of the setting sleeve 110 to minimize the movement of the setting sleeve 110 relative to the cone adapter 130. The setting sleeve 110, which is coupled to the setting tool, abuts the cone adapter 130 so that a setting tool can be used to set the slip assembly 120.

The mandrel 170 is disposed in the bore 132 of the cone adapter 130. In one embodiment, the bore 132 includes a recessed section 136 having a larger diameter to accommodate a shoulder 174 on the mandrel 170. The shoulder 174 may be used to retrieve the cone adapter 130 after setting the slip assembly 120. In another embodiment, a snap ring may be used to selectively attach the mandrel 170 to the cone adapter 130 for retrieval.

The cone 140 is arranged on the mandrel 170 with the inclined outer surface 141 facing the shoe member 150. The slip assembly 120 and the seal assembly 160 are at least partially disposed around the cone 140. In one embodiment, the slip assembly 120 overlaps with the cone 140 for an axial distance of 0.125 in. to 1.5 in. The seal assembly 160 and the slip assembly 120 are disposed between the shoe member 150 and the setting sleeve 110.

The slip assembly 120 may include a plurality of slip segments 122. Each slip segment 122 may include grooves 125 and gripping elements 128. For example, the gripping elements 128 may be one or more buttons. Two bands 124 may retain the slip segments 122 to the downhole tool 100. Each band 124 may be disposed in a corresponding groove 125 in the slip segments 122. In one embodiment, the bands 124 are expandable. Each slip segment 122 includes an inclined surface 121 corresponding to the inclined surface 141 of the cone 140. The inclined surface 121 of each slip segment 122 may include a friction surface, such as a plurality of teeth, configured to mate with the friction surface on the cone 140. The seal assembly 160 may be an elastomer ring as shown in FIG. 1. The seal assembly 160 includes an inclined surface 161 corresponding to the inclined surface 141 of the cone 140. As shown in FIG. 1, the seal assembly 160 may include one or more sealing protrusions 165 configured to engage the downhole surface.

In one embodiment, the slip segment 122 is made of a dissolvable non-metallic material. Suitable dissolvable non-metallic materials include dissolvable non-metallic polylactic acid (PLA) based polymers, polyglycolic acid (PGA) based polymers, degradable urethane, other polymers that are dissolvable over time. In one example, the slip segment 122 is manufactured using an injection molding process. The dissolvable non-metallic material is injected into a mold of the shape of the slip segment 122, where it is allowed to solidify before removal from the mold. The injection molding process advantageously provides for a lower cost slip assembly manufacturing process and for various designs of the slip assembly such as segmented, interconnected, or unitary body. In one embodiment, the bands 124 may be made of a dissolvable non-metallic material or a dissolvable metallic alloy.

To set the downhole tool 100, the slip assembly 120 travels along the inclined surface 141 of the cone 140 from a radially retracted position to a radially extended position, and the seal assembly 160 travels along the inclined surface 141 from a radially retracted position to a radially expanded position. When the slip assembly 120 is in the radially extended position, the gripping elements 128 grip (e.g., bite into) the downhole surface, such as an inner surface of a casing or the surface of the wellbore, to anchor the downhole tool 100 in place downhole. When the seal assembly 160 is in the radially expanded position, the seal assembly 160 is sealingly engaged with the downhole surface and blocks the annulus between the downhole tool 100 and the downhole surface. If present, the friction surface on the slip assembly 120 interacts with the friction surface of the cone 140 to prevent the slip segments 122 from traveling back down the inclined surface 141. In one example, the teeth of the slip assembly 120 interacts with the teeth on the cone 140 to maintain each slip segment 122 in the radially extended position. The extended slip segments 122 also maintain the seal assembly 160 in the radially expanded position. In some embodiments, the inclined surface 161 of the seal assembly 160 may include a friction surface, such as a plurality of teeth, configured to mate with the friction surface of the cone 140 to maintain the seal assembly 160 in the radially expanded position.

Alternatively, the seal assembly 160 may include a plurality of seal segments. The plurality of seal segments may include one or more sealing protrusions 165 and an inclined surface 161. The seal segments may have a wedged end configured to interlock with between two alternative slip segments of an alternative slip assembly. The alternative slip segments may have wedged ends. The alternative slip segments may further include one or more sealing protrusions configured to engage the downhole surface when moved to a radially extended position. When the alternative slip assembly and the alternative seal assembly 160 are set, the sealing protrusions 165 of the seal segments are configured to form a seal ring with the sealing protrusions of the slip segments. This seal ring seals the annulus between the downhole tool 100 and the downhole surface.

The mandrel 170 extends through the cone adapter 130. The upper portion of the mandrel 170 may include a bore, such as a blind bore, configured to receive a portion of the setting tool. The lower portion of the mandrel 170 is releasably attached to the shoe member 150 using the attachment member 190. The attachment member 190 may provide a shearable connection that can be activated to release the mandrel 170 from the shoe member 150. Exemplary attachment members 190 include a shearable pin, a shearable ring, a shearable bolt, a shearable threads, and other suitable shearable members.

FIGS. 2-6 illustrate an exemplary sequence of operating the downhole tool 100. FIG. 2 illustrates the downhole tool 100 after being deployed downhole by the setting tool (not shown) into a downhole tubular 300. The downhole tubular 300 may be a casing. FIG. 2 shows the slips assembly 120 partially disposed on the cone 140. The shoulder 174 on the mandrel 170 is located at the lower portion of the recessed section 136 of the bore 132 of the cone adapter 130.

Once deployed in the wellbore, the downhole tool 100 is set by the setting tool. The setting tool may be a wireline setting tool which uses conventional techniques of pulling the mandrel 170 while simultaneously pulling the slip assembly 120 against the cone 140. The cone 140, via the cone adapter 130, is axially abutted against the setting sleeve 110. As a result, the slip assembly 120, such as the slip segments 122, rides up the cone 140 and moves to the radially extended position to engage the downhole surface, such as the inner surface of the surrounding downhole tubular 300. In this manner, the slip assembly 120 anchors the first portion 106 in place in the downhole tubular 300. During the setting process, the cone adapter 130 may provide support for the cone 140 against the movement of the slips assembly 120. The slip assembly 120 also causes the seal assembly 160 to move up the inclined surface of the cone 140. As the seal assembly 160 moves up the inclined surface 141, the seal assembly 160 is expanded into the radially expanded position and sealingly engages with the downhole tubular 300. In one embodiment, the upper portion of the cone 140 may undergo a slight expansion during the setting process. The expanded cone 140 may facilitate separation of the cone 140 from the cone adapter 130.

Figure 3:
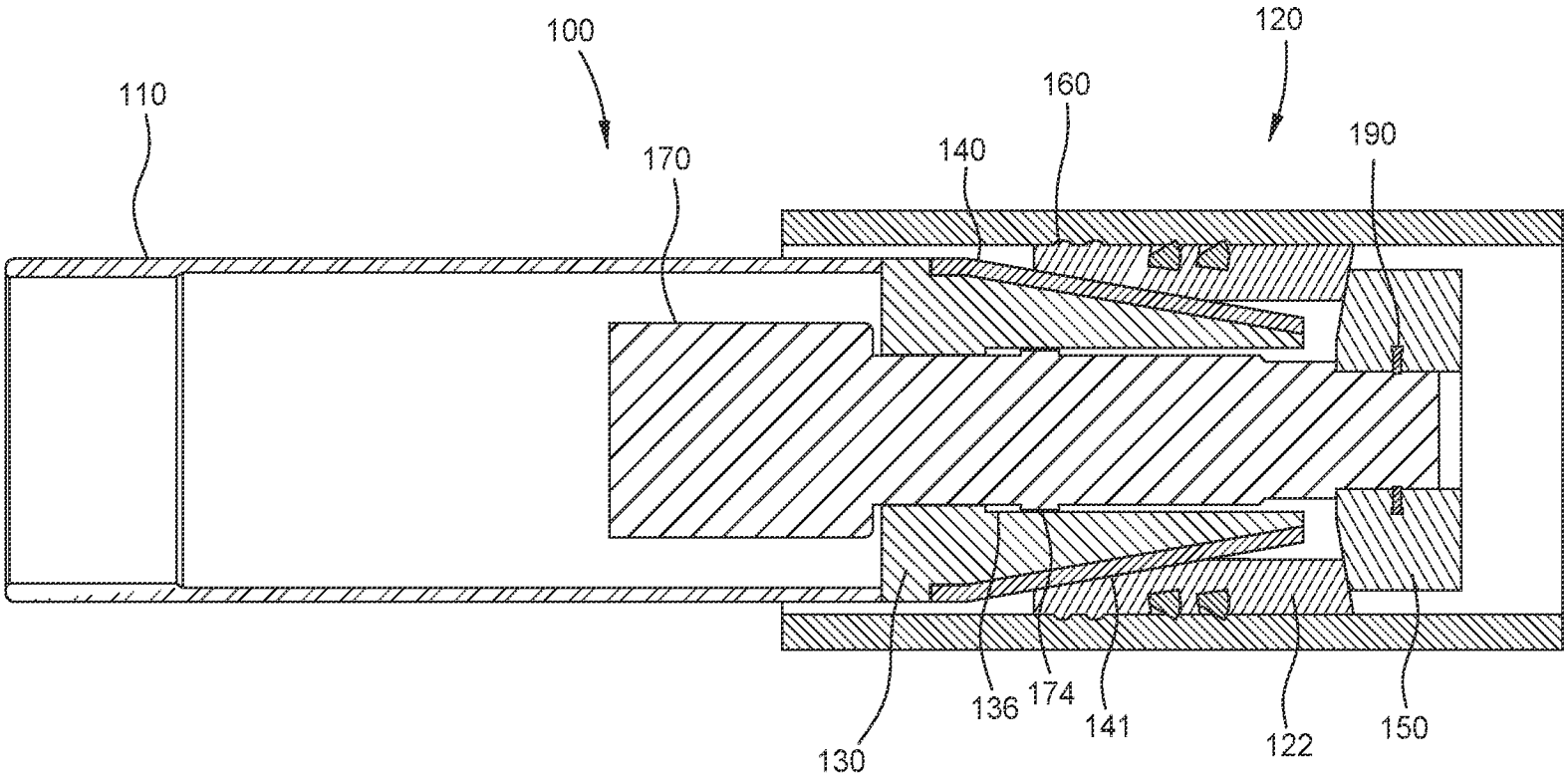
Figure 4:
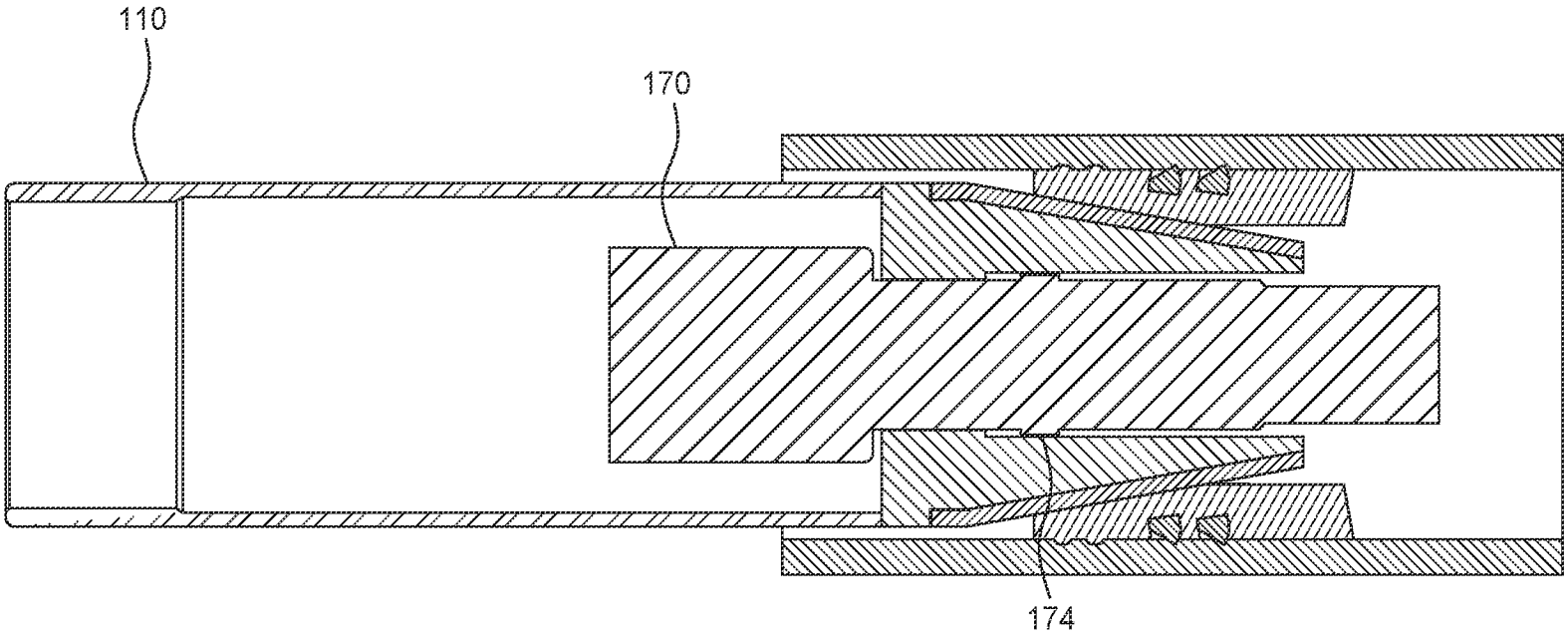

FIG. 3 illustrates the downhole tool 100 after force is applied to the mandrel 170 to engage the slip assembly 120 and the seal assembly 160 against the downhole tubular 300. It can be seen the slip assembly 120 is in the radially extended position and the seal assembly 160 is in the radially expanded position. Also, the shoulder 174 on the mandrel 170 has traveled partially along the recessed section 136, but has not reached the end of the recessed section 136 of the bore 132 of the cone adapter 130. The shoe member 150 has moved closer to the cone 140.

The setting tool continues to apply force to the mandrel 170 until the mandrel 170 is detached from the shoe member 150. In this respect, sufficient force is applied to the mandrel 170 cause the attachment member 190, such as a pin, to shear, thereby releasing the mandrel 170 from the shoe member 150. The shoe member 150 is no longer be seen in FIG. 4.

Figure 5:
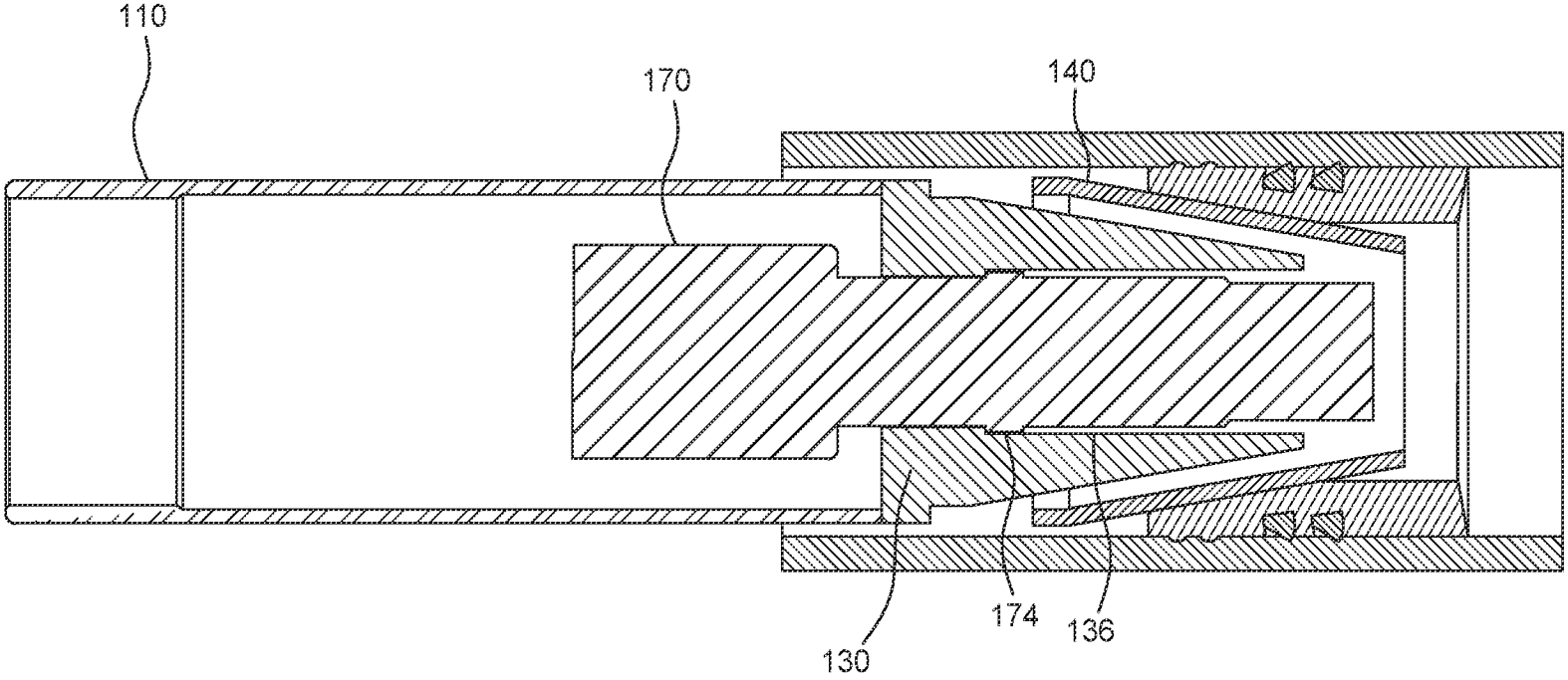

As the mandrel 170 is withdrawn from the cone 140 by the setting tool, the shoulder 174 on the mandrel 170 engages the shoulder at the end of the recessed section 136 of the cone adapter 130. In this respect, further withdrawal of the mandrel 170 moves the setting sleeve 110 and the cone adapter 130 away from the cone 140, as shown in FIG. 5. In this manner, the cone adapter 130 can be retrieved from the cone 140.

Figure 6:
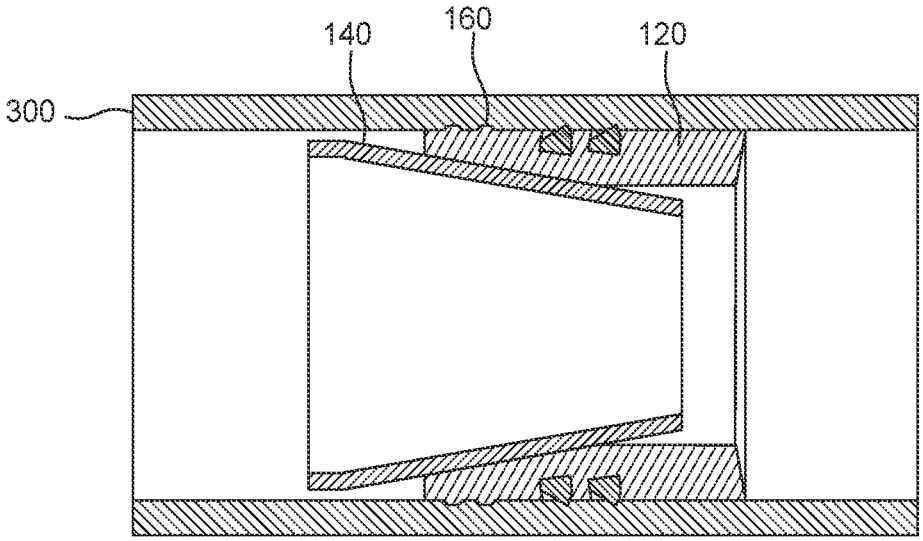

FIG. 6 shows the cone 140 after the cone adapter 130 and the mandrel 170 have been retrieved.

Figure 7:
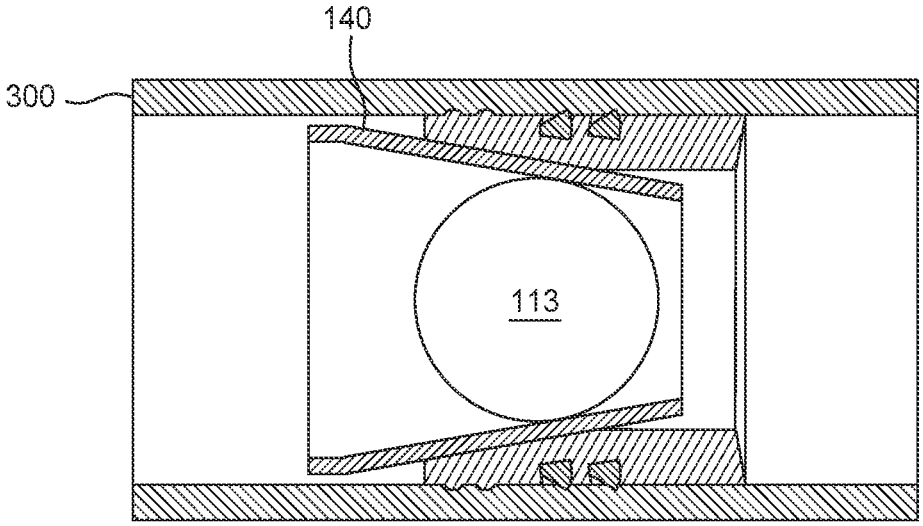
FIG. 7 illustrates a a cross-sectional view of the downhole tool showin in FIG. 6 with a ball landed in the cone.

Thereafter, an object 113, such as a ball, may be released into the wellbore. The ball may land in the cone 140 and close off fluid communication through the cone 140, as shown in FIG. 7. In some instances, the wellbore and downhole tubular 300 may be substantially vertical, which may result in the object 113 settling on the cone 140 due to gravitational forces. Instead of or in addition to gravitational forces, fluid pressure in the wellbore may be used to force the ball into engagement with the cone 140. For example, a fracturing fluid including one or more proppants may be introduced into the wellbore to urge the ball toward the cone 140.

Wellbore fluid pressure uphole of the ball 113 may be increased after the ball 113 lands in the cone 140. For example, fracturing fluid can be pressurized above seated ball 113 such that the fracturing fluid enters and fractures the formation surrounding the wellbore. While not wishing to be bound by theory, it is believed the thin profile of the cone 140 may help distribute the load evenly on the slip assembly 120 and the seal assembly 160. The thin profile of the cone 140 may also assist with energizing the seal assembly 160 and support the slip assembly 120 when fracturing pressure is applied.

In some embodiments, a mill-out operation is performed to remove the first portion 106, including the cone 140, from the wellbore. For example, the mill-out operation may occur after a fracturing operation.

In some embodiments, the first portion 106 includes a degradable material, such as a dissolvable material. For example, one or more chemical solutions may be pumped downhole to degrade one or more components of the first portion 106. As a result, one or more individual components of the first portion 106 may be degraded such that the first portion 106 may be flushed from the wellbore without the need of milling out the first portion 106. In one example, at least one of the slip assembly 120, the object 113, the cone 140, the shoe member 150, and the seal assembly 160 can be manufactured from a degradable material. Exemplary degradable materials may include degradable polymers, such as polylactic acid (PLA) based polymers, polyglycolic acid (PGA) based polymers, degradable urethane, and other polymers that are dissolvable over time. In one example, one or more components of the downhole tool 100 are composed of a dissolvable material. An exemplary dissolvable material is a dissolvable polymeric material. For example, the cone 140 and seal assembly 160 may be formed from a degradable polymer. In some embodiments, the slip assembly 120 includes slip segments 122 that are degradable. The degradable slip segments 122 may include non-degradable subcomponents. For example, the slip segments 122 may include gripping elements 128 which are formed from a non-degradable material, such as ceramic, powder metal, cast iron, ductile iron, and alloy steel. Exemplary degradable materials may include dissolvable metal alloys, such as magnesium alloys and aluminum alloys. For example, the slip assembly 120, object 113, the cone 140, and/or shoe member 150 may include a dissolvable metal alloy.

In some embodiments, one or components of the first portion 106 may be formed from a degradable material, such as a dissolvable metallic material, that is reactive with a chemical solution that is an electrolyte solution. The electrolyte solution to degrade the downhole tool may include an electrolyte is selected from the group comprising, consisting of, or consisting essentially of solutions of an acid, a base, a salt, and combinations thereof. A salt can be dissolved in water, for example, to create a salt solution. Common free ions in an electrolyte include, but are not limited to, sodium ($Na^+$), potassium ($K^+$), calcium ($Ca^{2+}$), magnesium ($Mg^{2+}$), chloride ($Cl^-$), bromide ($B^-$) hydrogen phosphate ($HPO_4^{2-}$), hydrogen carbonate ($HCO_3^-$), and any combination thereof. Preferably, the electrolyte contains halide ions such as chloride ions.

Embodiments of the downhole tool 100 decreases the time needed to complete a fracturing operation. The downhole tool 100 disclosed herein includes a cone 140 having a thinner profile. In this respect, the time needed to remove the cone 140 is significantly reduced compared to conventional cones. For example, less time will be required to mill out and/or dissolve the thinner profile cone 140

In some embodiments, the downhole tool 100 is used without a seal assembly 160.

In one embodiment, a downhole tool for use in a wellbore includes a cone, a cone adapter at least partially disposed in the cone, a shoe member, and a slip assembly disposed between the cone and the shoe member. A mandrel extends through the cone adapter and attached to the shoe member. The cone adapter is retrievable with the mandrel.

In one or more of the embodiments described herein, the cone adapter includes an incline surface complementary to an incline surface of the cone.

In one or more of the embodiments described herein, the cone adapter includes a shoulder disposed between the cone and a setting tool for setting the slip assembly.

In one or more of the embodiments described herein, a majority portion of the cone has a thickness from 0.3 in. to 1 in.

In one or more of the embodiments described herein, the cone has two different thicknesses.

In one or more of the embodiments described herein, a thickness of the cone at an upper end of the cone is thinner than a thickness of the cone adapter at the same axial location.

In one or more of the embodiments described herein, the cone adapter includes a bore for accommodating the mandrel, wherein the bore extends through the cone.

In one or more of the embodiments described herein, the mandrel includes a shoulder disposed in a recessed section of the bore of the cone.

In one or more of the embodiments described herein, the shoe member is releasably attached to the mandrel.

In one or more of the embodiments described herein, the downhole tool further includes a seal assembly.

In one or more of the embodiments described herein, the slip assembly includes a plurality of slip segments.

In one or more of the embodiments described herein, the slip assembly is at least partially disposed on an incline of the cone.

In one or more of the embodiments described herein, the cone includes a cone shaped bore.

In one embodiment, a method of performing a wellbore operation includes deploying a downhole tool into a wellbore using a setting tool. The downhole tool includes a cone supported by a cone adapter, a slip assembly; and a mandrel extending through the cone adapter and releasably attached to a shoe member. The method also includes using the setting tool to engage the slip assembly with a downhole surface, detaching the mandrel from the shoe member; and moving the cone adapter from the cone by retrieving the mandrel.

In one or more of the embodiments described herein, the downhole tool further includes a seal assembly, and the method includes contacting the seal assembly with the downhole surface.

In one or more of the embodiments described herein, the method includes moving a shoulder of the mandrel along a recessed section of a bore of the cone adapter.

In one or more of the embodiments described herein, the method includes abutting the shoulder of the mandrel with an end of the recessed section.

In one or more of the embodiments described herein, engaging the slip assembly causes expansion of at least a portion of the cone.

In one or more of the embodiments described herein, the method includes performing a fracturing operation.

In one or more of the embodiments described herein, detaching the mandrel from the shoe member includes shearing away a portion of the shoe member.

While the foregoing is directed to embodiments of the present disclosure, other and further embodiments of the disclosure may be devised without departing from the basic scope thereof, and the scope thereof is determined by the claims that follow.

What is claimed is:

1. A downhole tool, comprising:

a cone having a cone shaped bore;

a cone adapter at least partially disposed in the cone, the cone adapter having a cone shaped outer surface complementary to and configured to support the cone shaped bore of the cone;

a shoe member;

a slip assembly disposed between the cone and the shoe member;

a mandrel extending through the cone adapter and attached to the shoe member, wherein the cone adapter is retrievable with the mandrel.

2. The downhole tool of claim 1, wherein the cone adapter includes a shoulder disposed between the cone and a setting tool for setting the slip assembly.

3. The downhole tool of claim 1, wherein a majority portion of the cone has a thickness from 0.3 in. to 1 in.

4. The downhole tool of claim 3, wherein the cone has two different thicknesses.

5. The downhole tool of claim 1, wherein a thickness of the cone at an upper end of the cone is thinner than a thickness of the cone adapter at the same axial location.

6. The downhole tool of claim 1, wherein the cone adapter includes a mandrel bore for accommodating the mandrel, wherein the mandrel bore extends through the cone adapter.

7. The downhole tool of claim 6, wherein the mandrel includes a shoulder disposed in a recessed section of the mandrel bore of the cone adapter.

8. The downhole tool of claim 1, wherein the shoe member is releasably attached to the mandrel.

9. The downhole tool of claim 1, further comprising a seal assembly.

10. The downhole tool of claim 1, wherein the slip assembly includes a plurality of slip segments.

11. The downhole tool of claim 1, wherein the slip assembly is at least partially disposed on an incline of the cone.

12. A method of performing a wellbore operation, comprising:

deploying a downhole tool into a wellbore using a setting tool, the downhole tool including:

a cone supported by a cone adapter, the cone includes a cone shape bore and the cone adapter includes a cone shaped outer surface complementary to the cone shaped bore;

a slip assembly; and a mandrel extending through the cone adapter and releasaby attached to a shoe member;

using the setting tool to engage the slip assembly with a downhole surface;

detaching the mandrel from the shoe member; and moving the cone adapter away from the cone by retrieving the mandrel.

13. The method of claim 12, wherein the downhole tool further includes a seal assembly, and the method includes contacting the seal assembly with the downhole surface.

14. The method of claim 12, the method includes moving a shoulder of the mandrel along a recessed section of a mandrel bore of the cone adapter.

15. The method of claim 14, further comprising abutting the shoulder of the mandrel with an end of the recessed section.

16. The method of claim 12, wherein engaging the slip assembly causing expansion of at least a portion of the cone.

17. The method of claim 12, further comprising performing a fracturing operation.

18. The method of claim 16, wherein detaching the mandrel from the shoe member includes shearing away a portion of the shoe member.

19. A downhole tool, comprising:

a cone;

a cone adapter at least partially disposed in the cone, the cone adapter includes a mandrel bore extending through the cone adapter for accommodating a mandrel;

a shoe member;

a slip assembly disposed between the cone and the shoe member;

the mandrel extending through the cone adapter and attached to the shoe member, the mandrel includes a shoulder disposed in a recessed section of the mandrel bore of the cone adapter, wherein the cone adapter is retrievable with the mandrel.

* * * * *